United States Patent [19]

Norfolk et al.

[11] Patent Number: 5,022,171

[45] Date of Patent: Jun. 11, 1991

[54] MATRIX DISPLAY ASSEMBLY HAVING MULTIPLE POINT LIGHTING

[75] Inventors: Roy Norfolk, Umatilla, Fla.; Arnold Lazarus, Sayville, N.Y.

[73] Assignee: The Staver Company Inc., Bay Shore, N.Y.

[21] Appl. No.: 552,935

[22] Filed: Jul. 16, 1990

Related U.S. Application Data

[63] Continuation-in-part of Ser. No. 399,257, Aug. 28, 1989, Pat. No. 4,974,353.

[51] Int. Cl.[5] ..... G09F 9/30

[52] U.S. Cl. ..... 40/447; 40/452

[58] Field of Search ..... 340/764, 815.04, 815.05, 340/815.26, 815.27; 40/447, 449, 452

[56] References Cited

U.S. PATENT DOCUMENTS

| | | | |
|---|---|---|---|
| 1,594,703 | 8/1926 | Ballerini | 40/452 |
| 4,389,804 | 6/1983 | Seibert et al. | 40/447 |
| 4,761,905 | 8/1988 | Black | 40/447 |
| 4,769,638 | 9/1988 | Woolfolk | 40/449 X |
| 4,800,381 | 1/1989 | Joseph et al. | 340/764 |
| 4,833,806 | 5/1989 | Gars | 40/447 |
| 4,860,470 | 8/1989 | Browne | 340/815.05 X |
| 4,974,353 | 12/1990 | Norfolk | 40/447 |

FOREIGN PATENT DOCUMENTS

| | | | |
|---|---|---|---|
| 109328 | 5/1984 | European Pat. Off. | 340/764 |

*Primary Examiner*—James R. Brittain

*Attorney, Agent, or Firm*—Edward H. Loveman

[57] ABSTRACT

This graphic character matrix display assembly has a support providing a nonreflecting background for a multiplicity of display units arranged for cooperatively displaying the character. Each of the display units comprises a flat display disk having opposite sides. An electromagnet rotates the disk between display position and reversed position. A light source at each disk projects a light beam through a peripheral cutout in the disk when the disk is in display position. The light beam also projects an outline of the disk by backlighting. The periphery of the disk blocks the light beam when the disk is in reversed position. The light source for each disk may be an incandescent lamp, emitting diodes or the end of a light pipe.

11 Claims, 2 Drawing Sheets

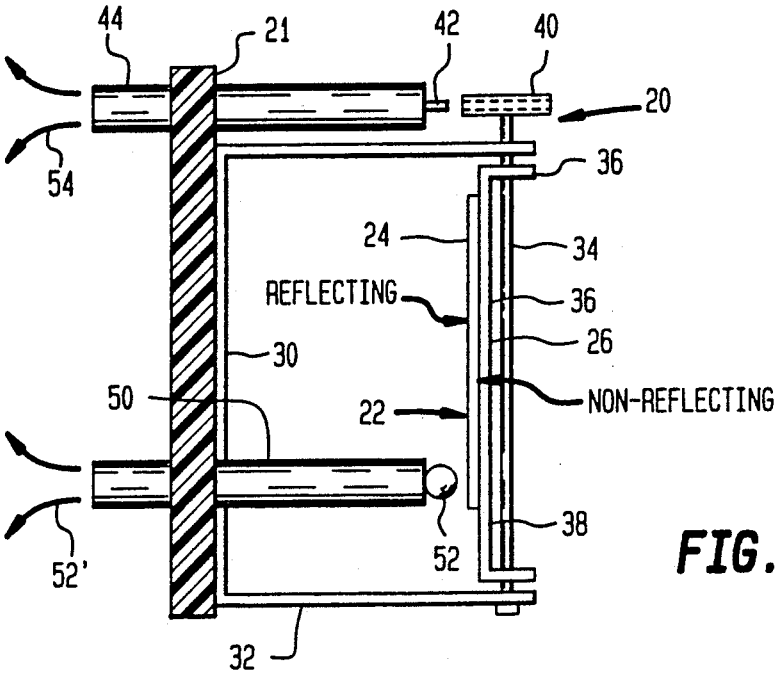
FIG. 2
FIG. 3
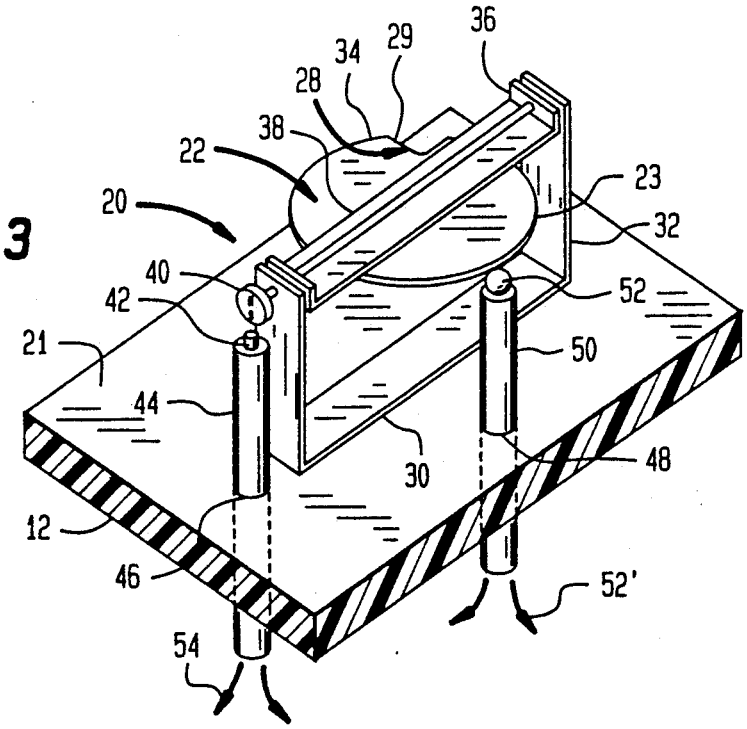
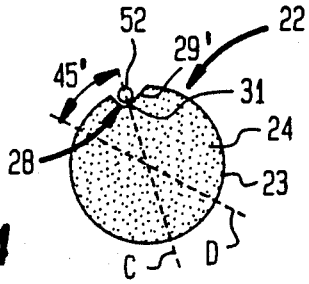
FIG. 4

MATRIX DISPLAY ASSEMBLY HAVING MULTIPLE POINT LIGHTING

This application is a continuation-in-part of copending application Ser. No. 399,257 filed Aug. 28, 1989, now U.S. Pat. No. 4,974,353, which issued on Dec. 4, 1990.

BACKGROUND OF THE INVENTION

1. Field of the Invention

This invention relates to display devices of the type employing a rectangular matrix of rotatable display disks colored brightly at one side for viewing by reflected light, and black colored on the other side for minimum light reflection when such other side is exposed. More particularly the invention concerns novel multiple point lighting for such a matrix display assembly with disks shaped to conceal and expose selectively the multiple point lighting.

2. Description of the Prior Art

Matrices of rotatable disks for display purposes have been described in such U.S. Pat. Nos. as 4,380,879 and 4,577,427. These matrices employ disks of various shapes rotated between reflecting and nonreflecting positions 180° apart. The disks carry permanent magnets which are electromagnetically actuated to turn the disk. Since the disks must be freely rotatable independently of each other they are disposed in a coplanar laterally spaced array. The spaces between the disks are generally closed by masks having multiple apertures in which the disks are exposed. For nighttime viewing, the prior displays employ lamps which are selectively turned on and off to project through the apertures in the masks when the disks are turned to fully open horizontal positions.

SUMMARY OF THE INVENTION

In normal daytime operating conditions, the present matrix exposes one side of the display elements or disks to ambient light to display any desired alphanumeric or other graphic characters without a mask. When ambient light is absent such as during night time hours, a spot lamp or other light behind each display element backlights the outline or perimeter of the display disk to display a silhouette and in addition projects a highly visible spot of light, through a radial cutout on the edge of the disk so that the daytime display effectively continues at night without change in position of the display disks. The grid of lamps or other light sources may be turned on by a conventional sensor, or may be always on so they automatically take over the display task when ambient light fails. The lamps are located behind the disks so that the edges of the disks conceal the light spots of those disks which are turned to non-display or reversed position. The light sources may be for example: incandescent lamps, light emitting diodes, fiber optics, light conduits, etc.

These and other objects and many of the attendant advantages of this invention will be readily appreciated as the same becomes better understood by reference to the following detailed description when considered in connection with the accompanying drawings in which:

BRIEF DESCRIPTION OF THE DRAWINGS

FIG. 2 is an enlarged fragmentary cross sectional view taken long line 2—2 of FIG. 1;

FIG. 3 is an enlarged perspective view of a display unit or assembly shown rotated to a horizontal position;

FIG. 4 is an enlarged elevational view partially diagrammatic in the form of a display disk per se such as employed in the matrix of FIG. 1 and the display units of FIGS. 2 and 3;

DESCRIPTION OF THE PREFERRED EMBODIMENTS

Figure 1:
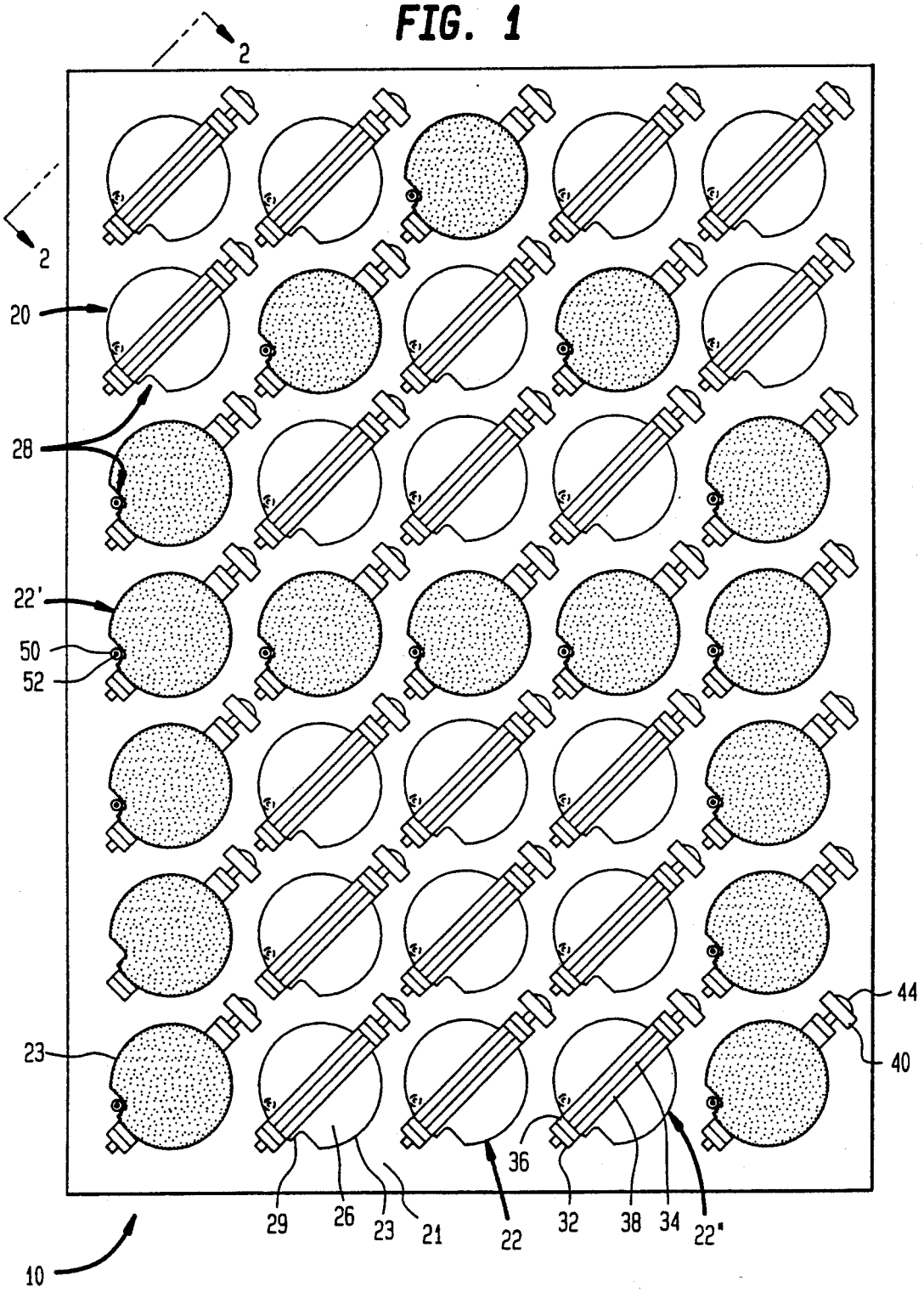
FIG. 1 is a front elevational view of a matrix display assembly embodying the invention.

Referring now to the drawings wherein like reference characters designate like or corresponding parts throughout, there is illustrated in FIG. 1 a matrix display assembly generally designated as reference numeral 10 which has a vertical rectangular, nonreflective or black panel or backboard 12 on which is mounted a rectangular array of display disk assemblies 20. Each disk assembly or unit 20 has a generally circular flat display disk 22. The disk assemblies 20 are shown in seven horizontal rows and five vertical columns to total thirty-five units in the matrix display assembly 10. Each disk has a colored light reflective display side 24, and a black or nonreflective side 26 and can be rotated approximately 180° to one of two positions so that either the colored side 24 faces forwardly and 20 is exposed to ambient light in display position as indicated by display disks 22' or the nonreflective side 26 faces forwardly in reverse position as shown by display units 22''. Each disk has a marginal L-shaped cutout or notch 28.

FIGS. 1, 2 and 3 show that each of the disks 22 of the display unit 20 is rotatably supported by a rectangular U-shaped bracket 30 secured at its back to the nonreflective side 21: of the backboard or background board 12. The bracket 30 has a pair of arms 32 apertured at their respective free ends to journal a rotatable shaft 34 which is secured to spaced leaves 36 at opposide ends of a bracket 38 secured to the black or nonreflecting side 26 of the disk 22. The outer end of the shaft 34 carries a permanent magnet 40 having diametrically opposite spaced N and S poles. The magnet rotates substantially 180° adjacent to a pole piece 42 of an electromagnet 44 set in a hole 46 in the board 12. Set in a hole 48 spaced laterally from bracket 30 and rearward of the disk 22 is a cylindrical lamp post 50 carrying a lamp 52. Wires 52' extend from the post 50 to a power supply circuit for energizing all the lamps 52 at the same time. Wires 54 extend from the electromagnet 44 to energize the same selectively when it is desired to turn either the reflecting side 24 or the nonreflecting side 26 to the viewing position.

The lamp 52 is so located so that it is disposed in the line of sight of the disk 22, radially inward of an edge 23 of the disk 22 when the disk 22 is turned to non-display position as shown by the disks 22'' in FIG. 1 and the disk 22 in FIGS. 2 and 3. The disk itself then blocks the light from the lamp 52. When the disks 22 are turned to the display position of the disks 22' in FIG. 1 with colored side 24 facing forwardly, the lamps 52 are exposed because the L-shaped radial cutouts of the slots 28 are turned upwardly. The axes of rotation of the disks 22 are disposed about 45° to the horizontal and vertical edges of the board 12. This orientation of the shafts 34 makes the best use of spaces between the disk assemblies or units 20 and makes it possible to provide a projection lamp 52 adjacent to the periphery of each disk 22. The lamps 52 are all disposed in a coplanar grid or array located behind the common plane of the disks 22. By this arrangement the lamps 52 can project light beams forwardly of those disks 22 which are in display position and at the same time the light beams back light onto the displayed disks to outline the silhouettes of the lamps at night when ambient light is absent. The imperforate portion of the disks themselves will block and conceal the light of all lamps behind those disks 22'' which are in a reversed, nonreflective, nondisplay position.

FIG. 4 shows a display disk 22 on an enlarged scale. The disk 22 has a circular periphery 23 and rotates on a diametral D. Circumferentially spaced from the axis D is an L-shaped peripheral cutout, slot or notch 28 whose central diametral axis C is spaced 45° from the axis D. The L-shaped cutout 28 has substantially straight sides 29, 29' spaced apart about 90°. The depth of the cutout 28 is about one-fifth of the diameter of the disk 22. The inner end 31 of the cutout 28 has a radius of curvature slightly larger than the radius of the lamp 52 and the spacing between the sides 29 is larger than the diameter of the lamp 52, so that the lamp 52 is fully exposed when the disk 22 is in display and reflective position.

In operation of the display matrix a plurality of disks 22 can be turned to indicate a character. For example, in FIG. 1, sixteen disks 22' are turned to display the letter "A" while remaining disks 22'' and panel 12 furnish a black or nonreflecting background. The lamps 52 may be turned on by a conventional light sensor or may be lit continuously, and under these circumstances, during daylight, the light from the lamps 52 are only faintly visible, because of the much more intense ambient light illuminating the display disks. In the absence of ambient light, such as at night, the lamps 52 at the L-shaped cutouts 28 become visible against the black background panel 12. The lamps 52 define the same character previously displayed by reflecting light from adjacent disks 22' and by back lighting because they are located in a plane behind the plane of the disks 22. Thus a very effective and novel display of the desired character is made even though there is no reflecting light impinging on the forward sides 24 of the display disks 22. Those lamps located behind the disks 22'' are rendered ineffective for display purposes even though the lamps 52 remain 20 lighted. If a different character is to be displayed, the disks 22 can be turned selectively, electromagnetically, to expose the lamps 52 of the selected disks 22' while the light from the lamps 52 of the other disks 22'' will be concealed or blocked. The peripheral location of the L-shaped cutout or notch 28 is critical in the present invention, because the small L-shaped notch permits a maximum imperforate area of the colored side of the disk 22 without holes to be displayed.

Instead of employing incandescent lamps 52, each of the lamps 52 can be replaced by a light emitting diode. As a further alternative for the individual incandescent lamps 52 or diodes, it is possible to employ a single lamp in a fiber optic array or grid as described in the parent application, of which this application is a continuation-in-part as mentioned above. In the fiber optic array or grid is a multiplicity of light pipes. The free end of each light pipe serves as a single source of light for one disk 22 in the matrix 10.

Although not illustrated, it is clear that the invention may be utilized with a display assembly where both sides of each of the display disks have the same color, i.e. black and in this instance, the visual display is only by projected light beams, from the light emitting from the light source 52 through cutouts 28 from those display disks 22 which are in the display position. The display disks 22 in the reverse position will have their respective light sources blocked by the disks themselves. Similarly, although the cutout or notch 28 has been illustrated to be L-shaped it clearly may be U-shaped or may be irregularly shaped.

The display matrix 10 may of course have more or less than the thirty-five disk display illustrated in FIG. 1, depending the specifications and requirements of any particular application.

It should be understood that the foregoing relates to only a preferred embodiment of the invention which has been by way of example only, and that it is intended to cover all changes and modifications of the examples of the invention herein chosen for the purpose of the disclosure, which do not constitute departures from the spirit and scope of the invention.

What is claimed is:

1. A graphic character matrix display assembly, comprising:

a support providing a nonreflecting background for said display;

a multiplicity of display units mounted on said support in an array for cooperatively displaying said character;

each of said display units comprising:

a flat non-apertured display a symmetry having axis a light reflecting side and a nonreflecting opposite side, and having a radial cutout at its periphery;

motive means on said support for rotating said display element substantially along the axis of symmetry of said display element between a light reflecting display position exposing said light reflective side and a reversed position exposing said nonreflecting side;

an illumination means carried by said support adjacent said display element and arranged to project said light beam forward of said display position through a cutout and to project an outline of said display element, when said disk is in said display position, said display element having an imperforate edge to block said light beam when said display element is in said reversed position;

whereby said character is displayed in ambient reflected light when certain ones of said disks are in said display position, and whereby said character is displayed in the absence of said ambient light by said projected light beams and by silhouettes of said certain disks by said light beams.

2. A graphic character matrix display assembly as claimed in claim 1, wherein said illuminating means is a lamp.

3. A graphic character matrix display assembly as claimed in claim 1, wherein said illuminating means is a light emitting diode.

4. A graphic character matrix as claimed in claim 1, wherein each of said display elements has a suitable geometric shape, and wherein said cutout is comprised of two spaced legs each extending inwardly from the periphery of said display element with their inner ends joined together for effectively passing said light beam thereinbetween when said display element is in said display position.

5. A graphic character matrix as claimed in claim 1, wherein said illuminating means is disposed to project said light beam upon the rear of said display element within said periphery thereof when said display element is in said reversed position to block said light beam.

6. A display unit for a graphic character matrix display assembly, comprising:

a flat non-apertured display element having a symmetry axis and light reflecting and non-reflecting opposite sides;

a support for rotatably mounting said display element and for providing a nonreflecting background behind said display element;

motive means on said support for rotating said display element substantially along the axis of symmetry of said display element between a light reflecting display position exposing said light reflecting side and a reversed position exposing said nonreflective side; and a light source carried by said support and disposed adjacent said display element to project a light beam forward of said display position and to project an outline of said display element, when said display element is in said display position, said display element having a cutout pheripheral portion arranged to transmit said light beam display element when said element is in said display position, said display element having an imperforate peripheral portion to block and conceal said light source when display element is in said reversed position.

7. A display unit as claimed in claim 6, wherein said light source is a lamp.

8. A display unit as claimed in claim 6, wherein said light source is a light emitting diode.

9. A display unit for a graphic character matrix display assembly, comprising:

a flat non-apertured display disk having a symmetry axis nonreflecting opposite sides and a peripheral radial notch;

a support for rotatably mounting said disk and for providing a nonreflecting background behind said disk;

motive means on said support for rotating said disk substantially along the axis of symmetry of said disk between a display position exposing one of said non-reflecting sides of said disk, and a reverse position to expose the other nonreflecting side of said disk;

a light source carried by said support and disposed adjacent said disk to project a light beam through said notch forward of said display position;

said disk having an imperforate edge portion arranged to block said light beam and to conceal said light source when said disk is in said reversed position.

10. A display unit as claimed in claim 9, wherein said light source is a lamp.

11. A display unit as defined in claim 9, wherein said light source is a light emitting diode.

* * * * *